US010870529B2

(12) United States Patent
Khatchaturian et al.

(10) Patent No.: US 10,870,529 B2
(45) Date of Patent: Dec. 22, 2020

(54) PACKAGING SYSTEM AND METHOD OF PACKAGING A BOTANICAL ARRANGEMENT USING THE SAME

(71) Applicants: SKY PAVE CORP., Burbank, CA (US); CREATIVE RETAIL PACKAGING INC., Houston, TX (US)

(72) Inventors: Lilit Khatchaturian, Burbank, CA (US); Dimas Hern, Burbank, CA (US); Olga Garabekyan, Burbank, CA (US); Steven B. Smith, Southport, CT (US); Meredith Elizabeth Bruner, Seattle, WA (US)

(73) Assignees: SKY PAVE CORP., Burbank, CA (US); CREATIVE RETAIL PACKAGING INC., Houston, TX (US)

( * ) Notice: Subject to any disclaimer, the term of this patent is extended or adjusted under 35 U.S.C. 154(b) by 131 days.

(21) Appl. No.: 15/985,004

(22) Filed: May 21, 2018

(65) Prior Publication Data

US 2019/0352086 A1 Nov. 21, 2019

(51) Int. Cl.

| | |
|---|---|
| ***B65D 85/50*** | (2006.01) |
| ***B65D 5/50*** | (2006.01) |
| ***B65D 5/66*** | (2006.01) |

(52) U.S. Cl.

CPC ..... *B65D 85/505* (2013.01); *B65D 5/509* (2013.01); *B65D 5/5026* (2013.01); *B65D 5/6611* (2013.01)

(58) Field of Classification Search

CPC ..... B65D 85/505; B65D 85/52; B65D 5/509; B65D 5/5026; B65D 5/6611;

(Continued)

(56) References Cited

U.S. PATENT DOCUMENTS 880,549 A * 3/1908 Lord ..... B65D 85/52 47/84
1,637,299 A * 7/1927 Graham ..... B65D 5/48026 229/120.21

(Continued)

FOREIGN PATENT DOCUMENTS

CA 2607891 A1 4/2009
GB 196869 A 5/1923

(Continued)

OTHER PUBLICATIONS

CakeBox on Food52, https://food52.com/shop/products/262-cakebox, last retrieved: Oct. 16, 2017.

*Primary Examiner* — Thanh K Troung
*Assistant Examiner* — Scott A Howell
(74) *Attorney, Agent, or Firm* — US IP Attorneys, P.C.; Timothy Marc Shropshire

(57) ABSTRACT

A method of packaging a botanical arrangement includes sliding an inner container holding the botanical arrangement into a front opening of an outer container. The inner container has a flanged portion, and the outer container has a track system configured such that the flanged portion of the inner container engages with the track system of the outer container during the sliding. In addition, the method includes closing the front opening of the outer container by lifting a hinged front panel of the outer container.

17 Claims, 9 Drawing Sheets

(58) Field of Classification Search
CPC .... B65D 5/5286; B65D 25/24; B65D 5/6617; B65D 5/38; B65D 5/723; B65D 5/728; B65B 7/168; B65B 19/18; B65B 19/20; B65B 43/26; B65B 2067/1261; B65B 2220/16; B65B 2220/04; B65B 2220/02; B65B 2230/02; B65B 5/04; B65B 25/02; B65B 25/023; B65B 25/026; B65B 7/20
USPC ..... 53/431; 47/84
See application file for complete search history.

(56) References Cited

U.S. PATENT DOCUMENTS 1,771,706 A * 7/1930 Cavanagh ..... B65D 85/18 206/8
2,235,473 A * 3/1941 Blinstrub ..... B65D 5/38 206/124
2,989,222 A * 6/1961 Haffenreffer ..... B65D 5/48012 229/120.13
3,284,949 A * 11/1966 Park ..... B65D 85/52 47/84
3,342,329 A 9/1967 Knight
3,664,062 A * 5/1972 Danielson ..... B65D 5/509 47/87
3,892,348 A * 7/1975 Rohner ..... B65D 5/321 229/120.011
4,170,301 A * 10/1979 Jones ..... B65D 85/52 206/423
5,224,598 A * 7/1993 Angeles ..... B65D 85/52 206/423
5,379,549 A 1/1995 Carcich et al.
5,441,151 A * 8/1995 Billingham ..... A47B 63/00 206/425
5,503,268 A * 4/1996 Pham ..... B65D 5/728 206/249
6,047,829 A * 4/2000 Johnstone ..... B65D 5/38 206/1.5
6,050,412 A 4/2000 Clough et al.
6,178,688 B1 * 1/2001 Keating ..... B65D 85/505 47/41.12
6,325,209 B1 * 12/2001 Humphrey ..... B65D 5/5038 206/320
6,581,777 B2 * 6/2003 Thibault ..... B65D 5/5026 206/470
7,066,321 B2 6/2006 Kawaguchi et al.
7,481,355 B2 1/2009 Hui
7,494,015 B2 * 2/2009 Bacon ..... B65D 5/4204 206/320
7,694,496 B2 4/2010 Keiger et al.
8,028,836 B2 * 10/2011 Bacon ..... B65D 5/0045 206/386
8,167,124 B2 5/2012 Uesugi et al.
8,196,749 B2 6/2012 Chatelain
8,225,931 B2 7/2012 Wharton
8,573,471 B2 11/2013 Wong
8,857,702 B2 10/2014 Hui
9,403,638 B2 * 8/2016 Polloni ..... B65D 85/1054
9,487,345 B1 * 11/2016 Vallejo ..... B65D 85/52

FOREIGN PATENT DOCUMENTS

KR 20-0192367 Y1 8/2000
KR 2010-0036797 A 4/2010
WO WO-98/58854 A1 12/1998

* cited by examiner

130

PACKAGING SYSTEM AND METHOD OF PACKAGING A BOTANICAL ARRANGEMENT USING THE SAME

BACKGROUND

Field

The present disclosure relates to systems and methods for packaging botanical arrangements.

Description of Related Art

Flowers are commonly purchased for special occasions and/or to express sentiments. While a simple batch of flowers wrapped in plastic can be shipped to some extent, this practice is not desirable for complex floral arrangements, because such arrangements are typically set in a vase or other ornamental container filled with water, which renders them not particularly suitable for shipping over long distances (e.g., out-of-state). Furthermore, when shipped, floral arrangements are prone to being damaged, to not remaining intact, and/or to experiencing water leakage. Accordingly, consumers may not be able to access an adequate level of quality with regard to intricate and fanciful floral arrangements due to their locale.

SUMMARY

A packaging system for a botanical arrangement includes an inner container configured to hold the botanical arrangement. The inner container has a flanged portion. In addition, the packaging system includes an outer container having a bottom panel, a track system on the bottom panel, and a front panel hinged to the bottom panel. The inner container is configured to slide into the outer container via the track system such that the flanged portion of the inner container is between the track system and the bottom panel of the outer container when the inner container is seated within the outer container.

A method of packaging a botanical arrangement includes sliding an inner container holding the botanical arrangement into a front opening of an outer container. The inner container has a flanged portion, and the outer container has a track system configured such that the flanged portion of the inner container engages with the track system of the outer container during the sliding. In addition, the method includes closing the front opening of the outer container by lifting a hinged front panel of the outer container.

A method of making a packaging system for a botanical arrangement may include fabricating a first blank for an inner container configured to hold the botanical arrangement. In addition, the method may include assembling the first blank to form the inner container such that the inner container has a flanged portion. The method may also include fabricating a second blank for an outer container configured to receive the inner container. Furthermore, the method may include assembling the second blank to form the outer container such that the outer container has a bottom panel, a track system on the bottom panel, and a front panel hinged to the bottom panel. The inner container is configured to slide into the outer container via the track system such that the flanged portion of the inner container is between the track system and the bottom panel of the outer container when the inner container is seated within the outer container.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
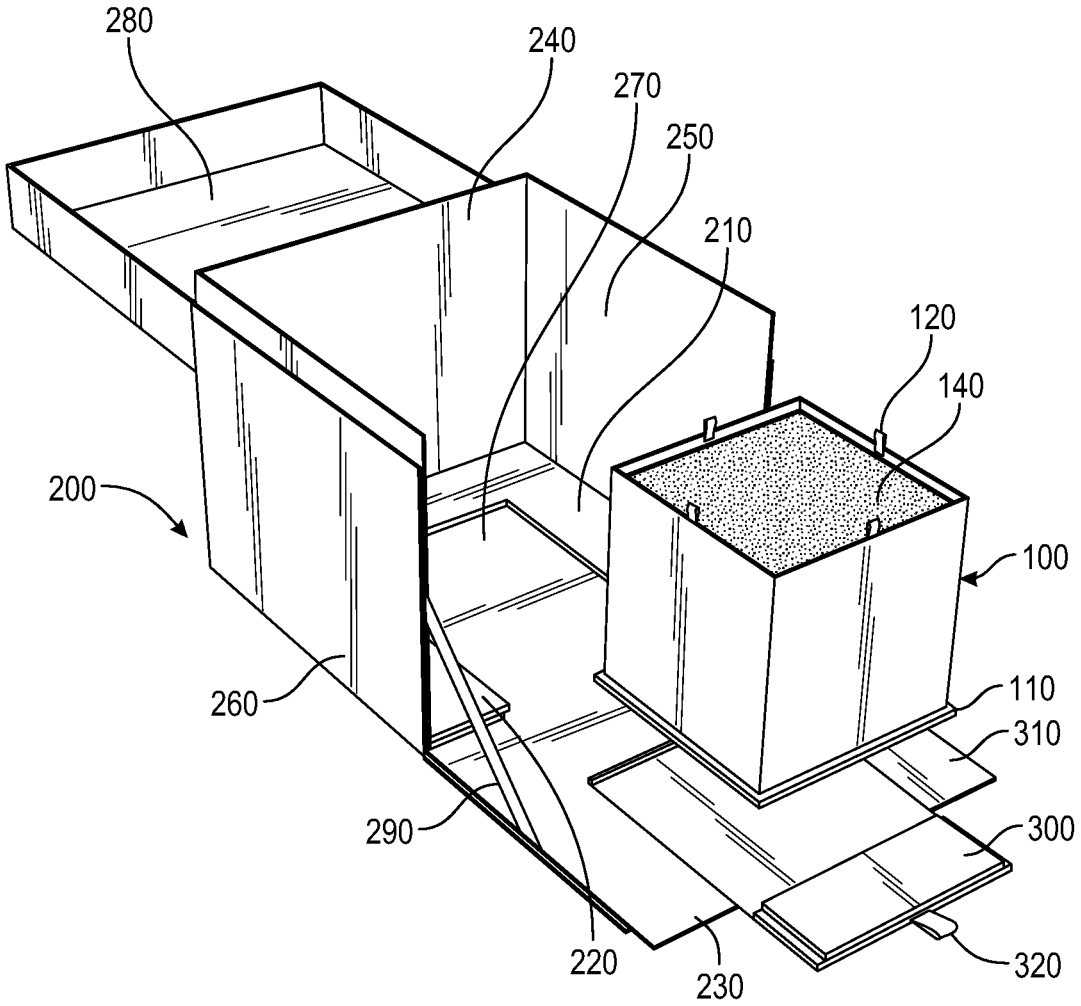
FIG. 1 is a perspective view of a method of packaging a botanical arrangement according to an example embodiment.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 1 is a perspective view of a method of packaging a botanical arrangement according to an example embodiment. Referring to FIG. 1, the method involves an inner container 100 and an outer container 200 configured to receive the inner container 100. The inner container 100 is configured to hold a botanical arrangement. For instance, the botanical arrangement may be a herbaceous arrangement (e.g., arrangement of fragrant herbs) and/or a floral arrangement (e.g., arrangement of roses). However, it should be understood that example embodiments are not limited thereto and that other organoleptically-pleasing arrangements may be held by the inner container 100.

The inner container 100 may also hold a foam 140 that supports the botanical arrangement. For instance, the foam 140 may be an open-celled phenolic foam configured to absorb and dispense water to the botanical arrangement. As a result, the foam 140 can help hold the botanical arrangement in place while also prolonging the life of the botanical arrangement. The foam 140 may be a monolithic structure with a size and shape that corresponds to an interior space of the inner container 100. When water is to be supplied to the foam 140, the inner container 100 may include a liner that is impermeable to liquids to prevent leakage. In a non-limiting embodiment, the liner may be in a form of a film that conformally coats internal surfaces of the inner container 100. Alternatively, the liner may be in a form of an insert configured to be seated within the inner container 100, which will be discussed in further detail herein.

One or more fasteners 120 may be provided to help retain the foam 140 within the inner container 100. The fasteners 120 may be provided at or near a rim of the inner container 100. In an example embodiment where the inner container 100 has four side walls, then a fastener 120 may be provided for each side wall. In one instance, the fasteners 120 may be loops configured to interact with a complementary structure (e.g., zip tie) to secure the foam 140. In another instance, the fasteners 120 may be catch structures (e.g., hooks) configured to engage with an elastic structure (e.g., rubber band) to secure the foam 140. In another instance, the fasteners 120 may be elongated strips of material (e.g., ribbons) that can be tied together to secure the foam 140. In yet another instance, the fasteners 120 may be tabs formed of a malleable material (e.g., metal) configured to be bent inwards to help secure the foam 140.

The inner container 100 includes a flanged portion 110 that forms a lower periphery of the inner container 100. The flanged portion 110 may have a planar upper surface. In FIG. 1, the flanged portion 110 extends beyond all four sides of the inner container 100. Alternatively, the flanged portion 110 may extend beyond only two opposing sides of the inner container 100.

The outer container 200 includes a front panel 230, a rear panel 240, a first side panel 250, a second side panel 260, a bottom panel 270, and a top panel 280. The front panel 230 is hinged to the bottom panel 270 so as to allow a transition between an open position (e.g., horizontal position) and a closed position (e.g., vertical position). A connector 290 may also be used to link the front panel 230 to the first side panel 250 and the second side panel 260 (e.g., so as to resemble a draw bridge). In particular, the connector 290 may have a length that prevents the front panel 230 from swinging beyond a horizontal position (e.g., position that is substantially coplanar with the bottom panel 270) when the outer container 200 is picked up while the front panel 230 is in the open position. The connector 290 may be a flexible material (e.g., ribbon, string) of adequate strength to function as the requisite link. Alternatively, the connector 290 may be a rigid material configured to retract into the first side panel 250 and the second side panel 260 when the front panel 230 transitions to the closed position and to protract from the first side panel 250 and the second side panel 260 when the front panel 230 transitions to the open position. The top panel 280 is hinged to the rear panel 240 so as to allow a transition between an open position and a closed position. As shown in FIG. 1, the top panel 280 is part of the lid of the outer container 200.

A track system 210 is disposed on the bottom panel 270 of the outer container 200. The track system 210 has an overhang portion 220 configured to engage with the flanged portion 110 of the inner container 100 when the inner container is being received and held by the outer container 200. Notably, the track system 210 is configured to restrict a vertical displacement and a horizontal displacement of the inner container 100 once the inner container 100 is seated within the outer container 200. As a result of the stabilization of the inner container 100 by the track system 210 of the outer container 200, a relatively intricate botanical arrangement (e.g., flowers) can be created and shipped without damaging the arrangement.

In an example embodiment, the track system 210 runs in a continuous manner along the first side panel 250, the rear panel 240, and the second side panel 260 of the outer container 200. For instance, the track system 210 may be formed of a lower U-shaped structure that is secured to the bottom panel 270 and an upper U-shaped structure that is secured to the lower U-shaped structure. Both the upper U-shaped structure and the lower U-shaped structure are dimensioned so as to abut the first side panel 250, the rear panel 240, and the second side panel 260 of the outer container 200. In addition, the legs and base of the upper U-shaped structure are wider than the legs and base of the lower U-shaped structure. As a result, the inner edge of the upper U-shaped structure will extend beyond the inner edge of the lower U-shaped structure so as to form the overhang portion 220 of the track system 210. In a non-limiting embodiment, the degree of extension of the overhang portion 220 relative to the lower U-shaped structure corresponds to the degree of extension of the flanged portion 110 relative to a corresponding side wall of the inner container 100. Consequently, a relatively close fit will be provided when the inner container 100 is engaged with the track system 210 and seated within the outer container 200. It should be understood that, as an alternative to the upper U-shaped and lower U-shaped structures discussed above, the track system 210 may be formed as a single U-shaped structure with the overhang portion 220.

The front panel 230, the rear panel 240, the first side panel 250, the second side panel 260, and the bottom panel 270 of the outer container 200 may have a double panel structure. For instance, each of the front panel 230, the rear panel 240, the first side panel 250, the second side panel 260, and the bottom panel 270 of the outer container 200 may be composed of an interior panel and an exterior panel that is wider but shorter than the interior panel. In such an instance, the interior panel of the front panel 230 will abut the interior panels of the first side panel 250 and the second side panel 260 when the front panel 230 is raised to the closed position (e.g., vertical position). At the same time, the exterior panel of the front panel 230 will also abut the exterior panels of the first side panel 250 and the second side panel 260 in this closed position. The upper sections of the interior panels will also be exposed as a result of their greater height. Consequently, when the lid (which includes the top panel 280) is flipped to the closed position, the exposed sections of the interior panels will engage with the concave underside of the lid, thereby providing lateral support for the lid.

As an alternative to the double panel structure, it should be understood that the front panel 230, the rear panel 240, the first side panel 250, the second side panel 260, and the bottom panel 270 of the outer container 200 may have a single panel structure. In such an embodiment, rather than a concave underside for the lid, the top panel 280 may have a pivotable flap at its distal end (relative to the hinge with the rear panel 240) for adherence to the front panel 230 (e.g., via a magnet, snap-fit connection, friction-fit slot, re-adherable adhesive) to maintain a closed position for the outer container 200.

A glide structure 310 may be used when the inner container 100 is of a size that nears or exceeds the one-hand grip span of the intended recipient (e.g., inner container 100 with a width of more than 5 or 6 inches (12.7 or 15.24 mm)). The glide structure 310 includes a tab 320 at the proximal end upon which the recipient will pull to remove the inner container 100 from the track system 210 of the outer container 200. In an example embodiment, the glide structure 310 is a sheet material (e.g., paper-based) of sufficient strength to facilitate the insertion and/or removal of the inner container 100. The distal end of the glide structure 310 may have a raised section configured to ensure that the inner container 100 will be removed with the glide structure 310 when the tab 320 is pulled rather than just the glide structure 310 being pulled out while the inner container 100 still remains seated in the track system 210 of the outer container 200. The raised section at the distal end of the glide structure 310 may be any part that can fit within the track system 210 while also being of suitable strength to urge the inner container 100 outward when the tab 320 is pulled. For instance, the raised section may be a separately-adhered ridge part or a folded end of the glide structure 310. In another instance, as an alternative (or in addition to) the raised section, the sheet material of the glide structure 310 may be provided with a low tack adhesive to provide the requisite friction for removal of the inner container 100 when the tab 320 is pulled. Otherwise, removing an inner container 100 (that is too large for the recipient) from the track system 210 without a glide structure 310 may be cumbersome and may detract from the excitement and awe from the presentation of the floral arrangement.

A stopper 300 may be provided separately in conjunction with or as an integrally-formed part of the glide structure 310. The stopper 300 is configured to engage with the track system 210 so as to occupy substantially an entirety of the space between the flanged portion 110 of the inner container 100 and the front panel 230 when the front panel 230 is in the closed position. As a result, the degree of freedom of the inner container 100 will be restricted, thereby protecting the inner container 100 (and the floral arrangement therein) from unwanted vertical and horizontal displacements when the outer container 200 is in transit to a recipient. The stopper 300 may also be used in the absence of the glide structure 310 (e.g., when the inner container 100 is regarded as being small enough to be gripped single-handedly for removal by the recipient). In such an instance, the tab 320 may be attached to the stopper 300. On the other hand, when a glide structure 310 is used, the tab 320 may be connected to the stopper 300 or the underlying sheet material.

The material(s) of construction of the inner container 100, the outer container 200, and optional components such as the stopper 300 and the glide structure 310 are not particularly limited. For instance, the material(s) of construction may include a cellulose-based material (e.g., paper, cardboard, wood, bamboo), plastic (e.g., polyethylene, acrylic), and/or metal. However, it should be understood that other materials having sufficient strength and durability may be used.

Figure 2:
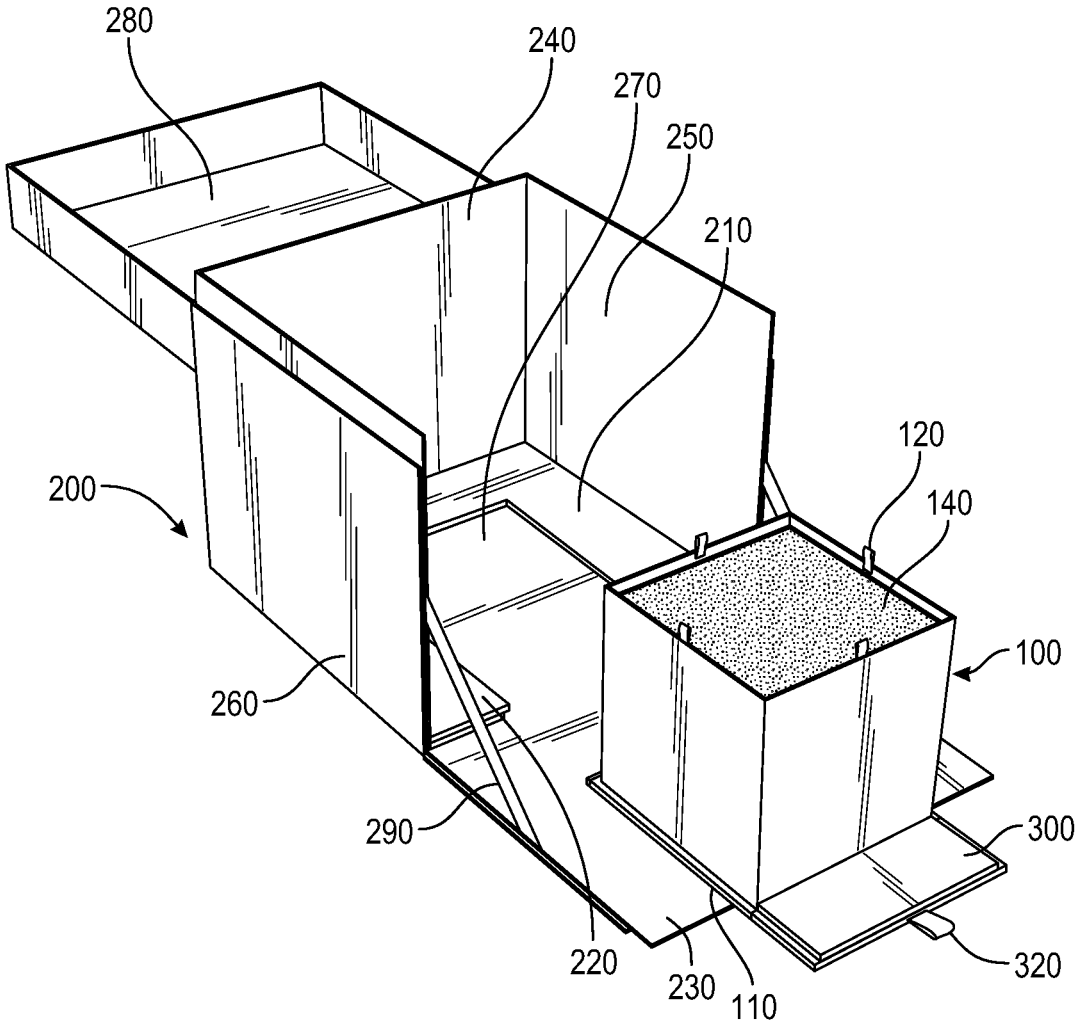
FIG. 2 is a subsequent view of the method of FIG. 1, wherein the inner container is disposed on the glide structure.

FIG. 2 is a subsequent view of the method of FIG. 1, wherein the inner container is disposed on the glide structure. Although not shown, after wetting the foam 140 with water and setting the foam 140 within the inner container 100, the foam 140 is secured to the inner container 100 using the fasteners 120. In a non-limiting embodiment, the fasteners 120 may be connected with one or more zip ties to ensure that the foam 140 remains in the inner container 100. For instance, opposing fasteners 120 may be connected with zip ties. In another instance, adjacent fasteners 120 may be connected with zip ties. In yet another instance, all the fasteners 120 may be connected with one large zip tie.

Once the foam 140 is secured within the inner container 100, botanic articles (e.g., cut flowers, ornamental grasses, decorative branches, etc. as well as faux versions of such articles) are inserted into the foam 140 to create the botanical arrangement. The foam 140 has a structure that allows it to function as a support that holds the botanical arrangement in place while providing a supply of water via capillary action, which will prolong the life of the botanical arrangement. In addition, because the water is absorbed within the foam 140 which is secured in the inner container 100, spillage of the water can be significantly reduced or prevented during the jostling and/or temporary misorientation that may occur when the packaged arrangement is being shipped.

Upon creation of the botanical arrangement, the inner container 100 may be disposed on the glide structure 310. For instance, flanged portion 110 of the inner container 100 may abut the stopper 300, although example embodiments are not limited thereto. In another instance, the thickness of the flanged portion 110 of the inner container 100 may be essentially be the same as the thickness of the stopper 300.

Figure 3:
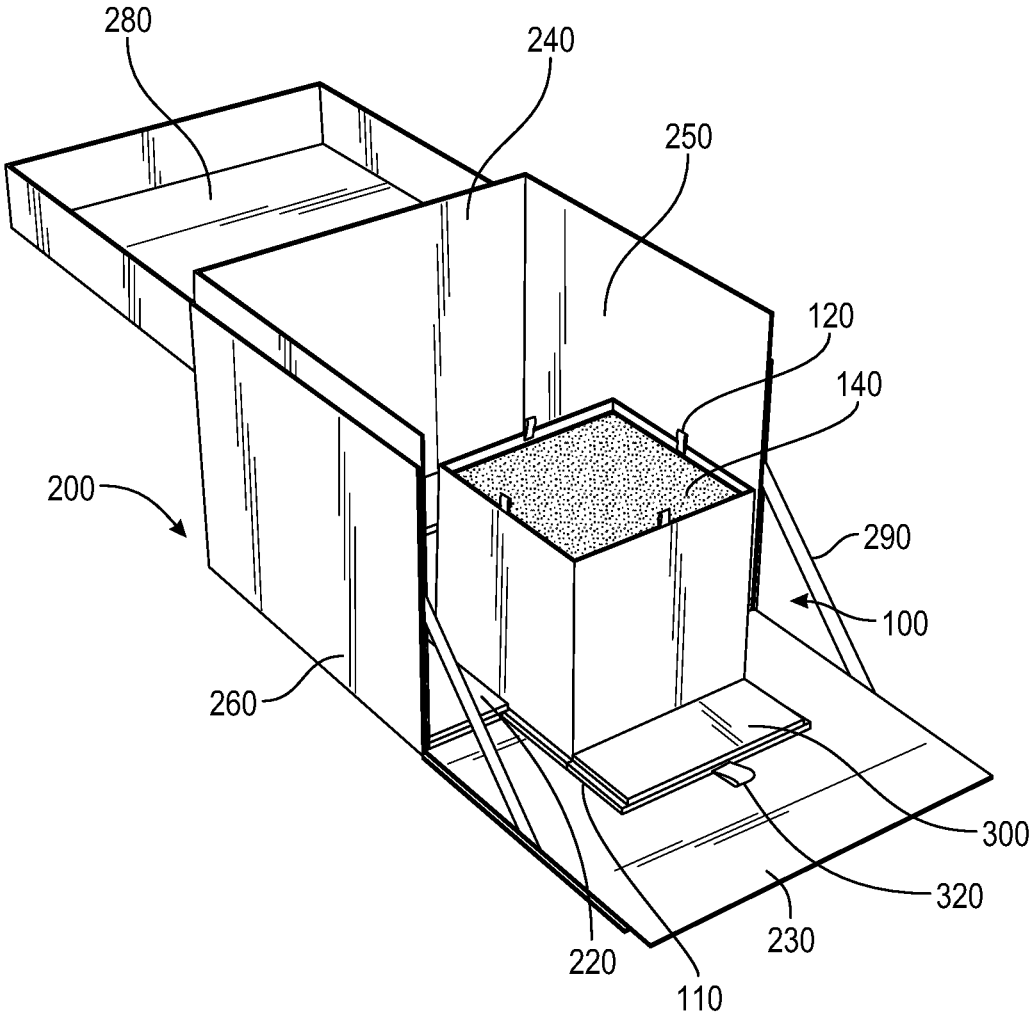
FIG. 3 is a subsequent view of the method of FIG. 2, wherein the flanged portion of the inner container is engaged with the track system of the outer container.

FIG. 3 is a subsequent view of the method of FIG. 2, wherein the flanged portion of the inner container is engaged with the track system of the outer container. Referring to FIG. 3, the inner container 100 is aligned with the outer container 200 such that the flanged portion 110 becomes engaged with the track system 210 upon sliding the inner container 100 from the front opening toward the rear panel 240 of the outer container 200. In an example embodiment, the front panel 230 is substantially coplanar with the bottom panel 270 during the sliding of the inner container 100, which is performed in a horizontal manner. The inner container 100 is also shorter than the outer container 200 to allow the inner container 100 to be completely enclosed by the outer container 200.

Figure 4:
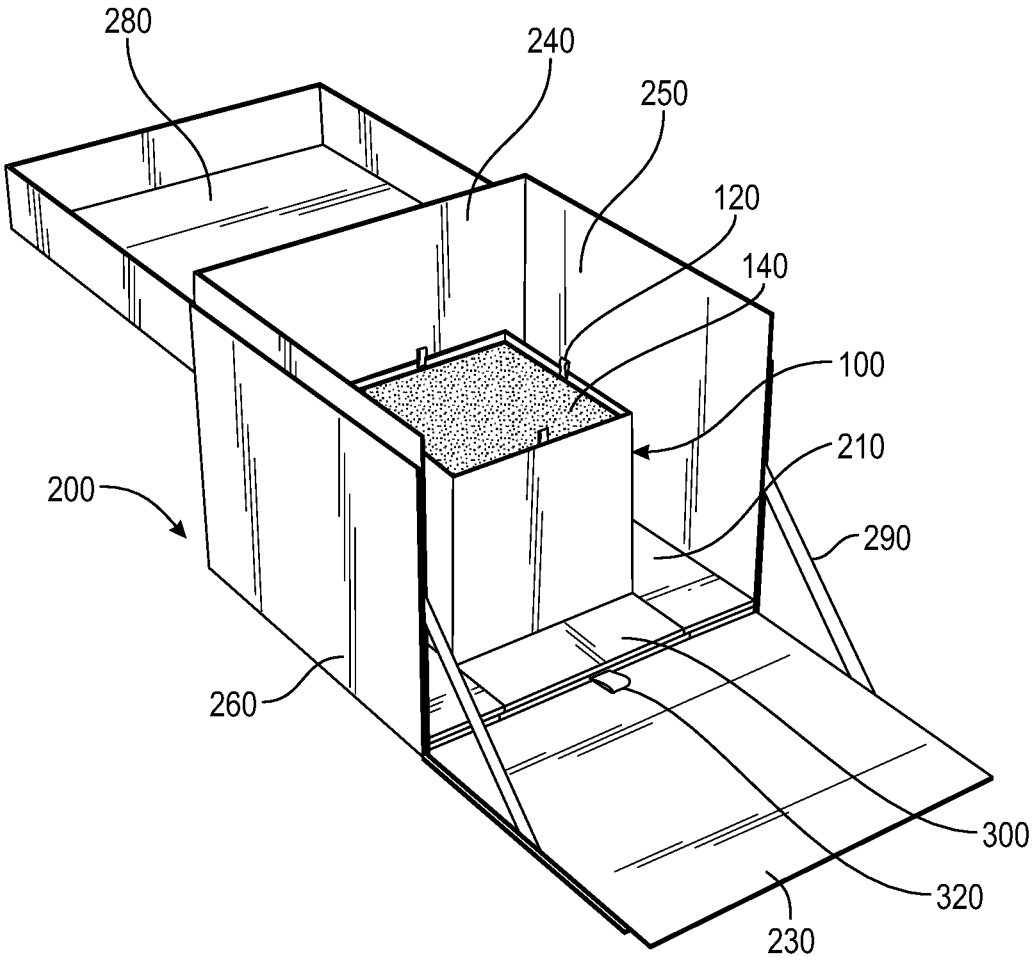
FIG. 4 is a subsequent view of the method of FIG. 3, wherein the inner container is fully positioned within the outer container.

FIG. 4 is a subsequent view of the method of FIG. 3, wherein the inner container is fully positioned within the outer container. Referring to FIG. 4, the sliding may be performed to seat the inner container 100 in a center of the outer container 200. In instances where a glide structure 310 is not used, the flanged portion 110 of the inner container 100 will contact both the track system 210 and the bottom panel 270 of the outer container 200. To further reduce the degree of available movement of the inner container 100, a stopper 300 is engaged with the track system 210 to fill the remaining space between the inner container 100 and the hinged front panel 230 prior to the closing of the front opening of the outer container 200. The fit of the inner container 100 and the stopper 300 within the track system 210 may be sufficiently close that the flanged portion 110 along the first side panel 250, the rear panel 240, and the second side panel 260 are not visible once the inner container 100 is fully seated in the outer container 200. In a non-limiting embodiment, the degree of movement of the fully seated inner container 100 is not more than 3 mm in a lateral direction and 3 mm in a vertical direction.

Figure 5:
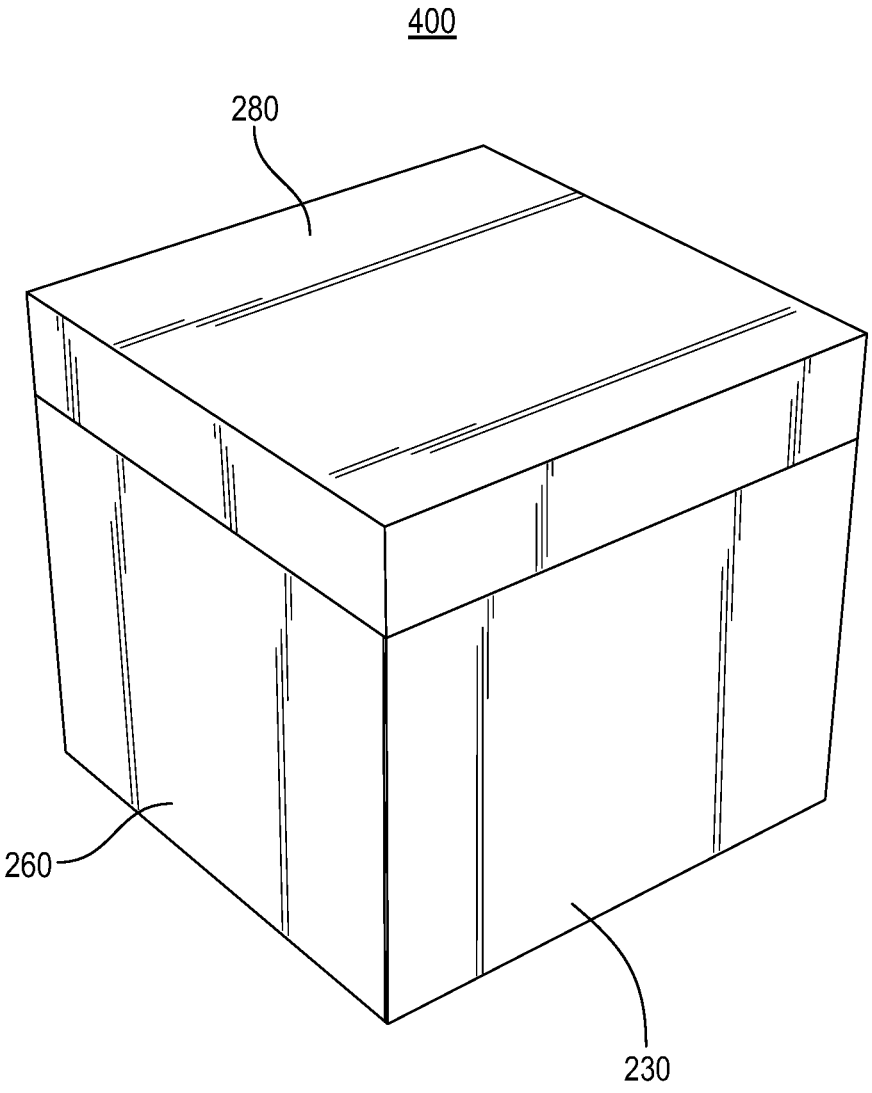
FIG. 5 is a subsequent view of the method of FIG. 4, wherein the outer container is closed.

FIG. 5 is a subsequent view of the method of FIG. 4, wherein the outer container is closed. Referring to FIG. 5, once the inner container 100 is fully seated within the track system 210, the outer container 200 may be closed by lifting the front panel 230 to a closed position (e.g., vertical position) and flipping the lid (which includes the hinged top panel 280) forward to close the top opening of the outer container 200 while also engaging the concave underside of the lid with the exposed interior panels of the front panel 230, the rear panel 240, the first side panel 250, and the second side panel 260. When the outer container 200 is closed, the exterior side surfaces of the lid may be substantially flush with corresponding exterior side surfaces of the front panel 230, the rear panel 240, the first side panel 250, and the second side panel 260. In addition to the clean and symmetrical look of the packaged arrangement 400, the inner container 100 within is adequately stabilized such that the floral arrangement can be shipped a relatively long distance (e.g., from California to New York) without adversely affecting the integrity and aesthetic appeal of the floral arrangement.

The packaged arrangement 400 may be placed inside an appropriate shipping box prior to sending to avoid unnecessarily soiling or otherwise diminishing its appearance. Upon receipt of the packaged arrangement 400, the recipient can open the packaged arrangement 400 in the reverse order described in connection with FIGS. 1-5. The presentation of the floral arrangement when the front panel 230 is lowered along with the sliding of the floral arrangement from the outer container 200 via the track system 210 enhances the overall experience of the moment.

Figure 6:
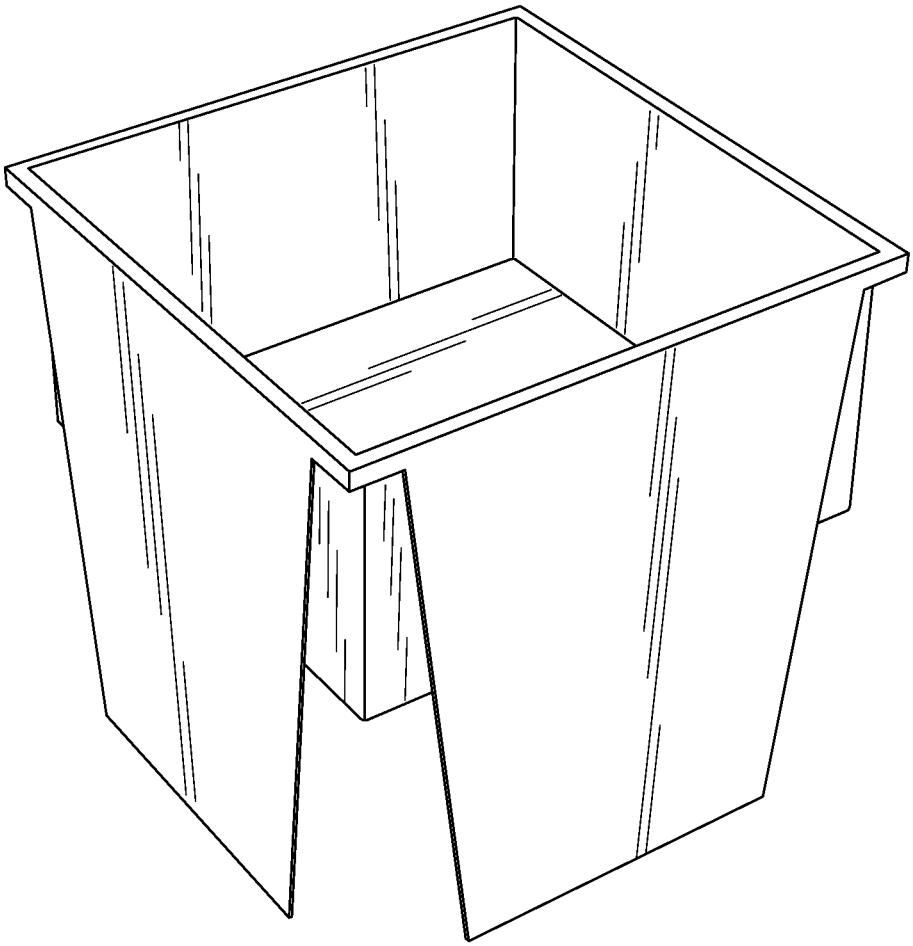
FIG. 6 is a perspective view of a liner for a packaging system for a botanical arrangement according to an example embodiment.

FIG. 6 is a perspective view of a liner for a packaging system for a botanical arrangement according to an example embodiment. Referring to FIG. 6, the liner 130 is impermeable to liquids (e.g., water) and is in a form of an insert configured to be seated within the inner container 100. The liner 130 may be an alternative to a liner that is in a form of a film (e.g., plastic, wax) that conformally coats the internal surfaces of the inner container 100.

Figure 7:
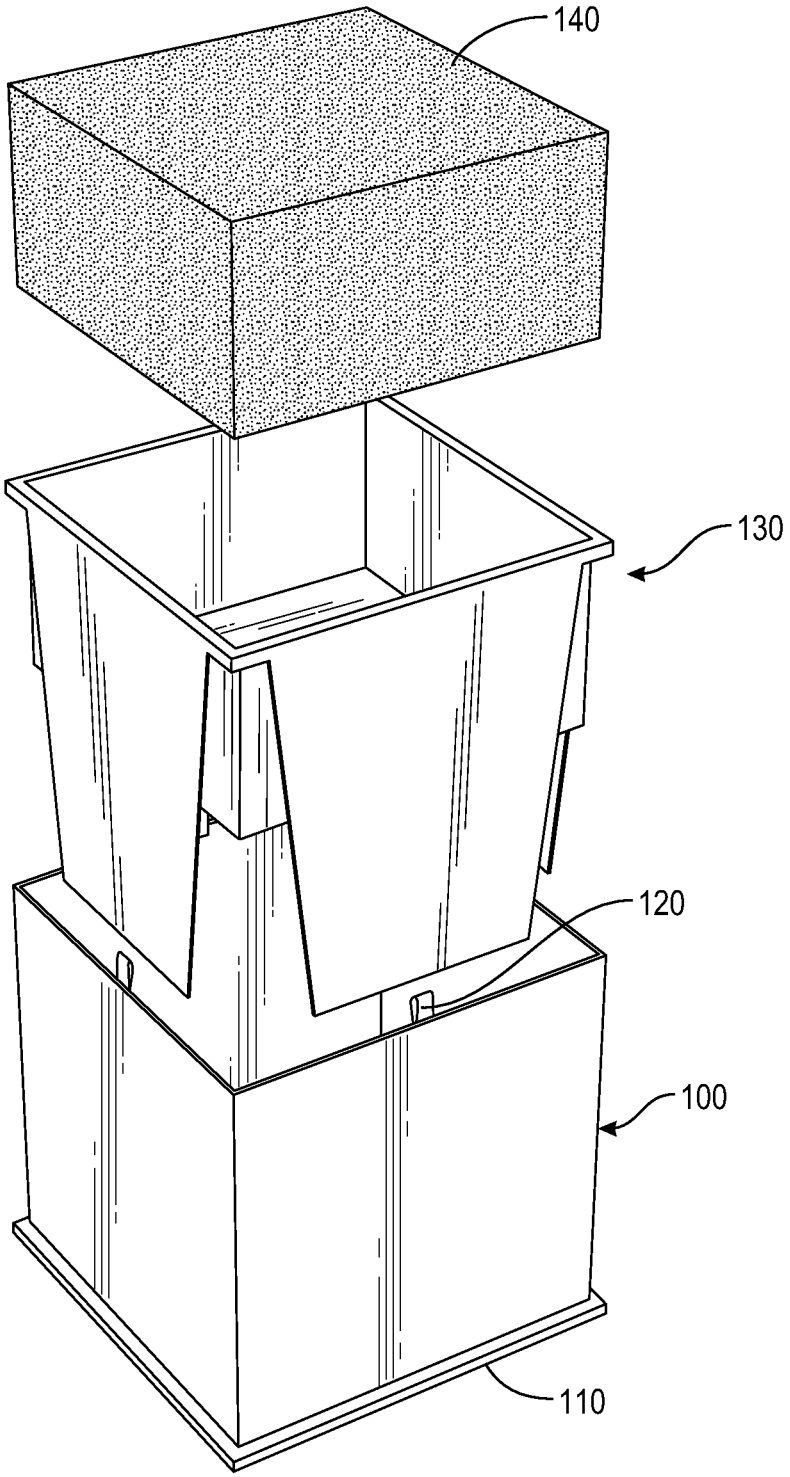
FIG. 7 is a perspective view of the liner of FIG. 6 together with a foam and an inner container.

FIG. 7 is a perspective view of the liner of FIG. 6 together with a foam and an inner container. Referring to FIG. 7, the liner 130 is configured to receive a foam 140 that is dimensioned to substantially coincide with an interior space of the liner 130. The liner 130 is also configured to be seated within the inner container 100 via a friction or interference fit, although example embodiments are not limited thereto.

Figure 8:
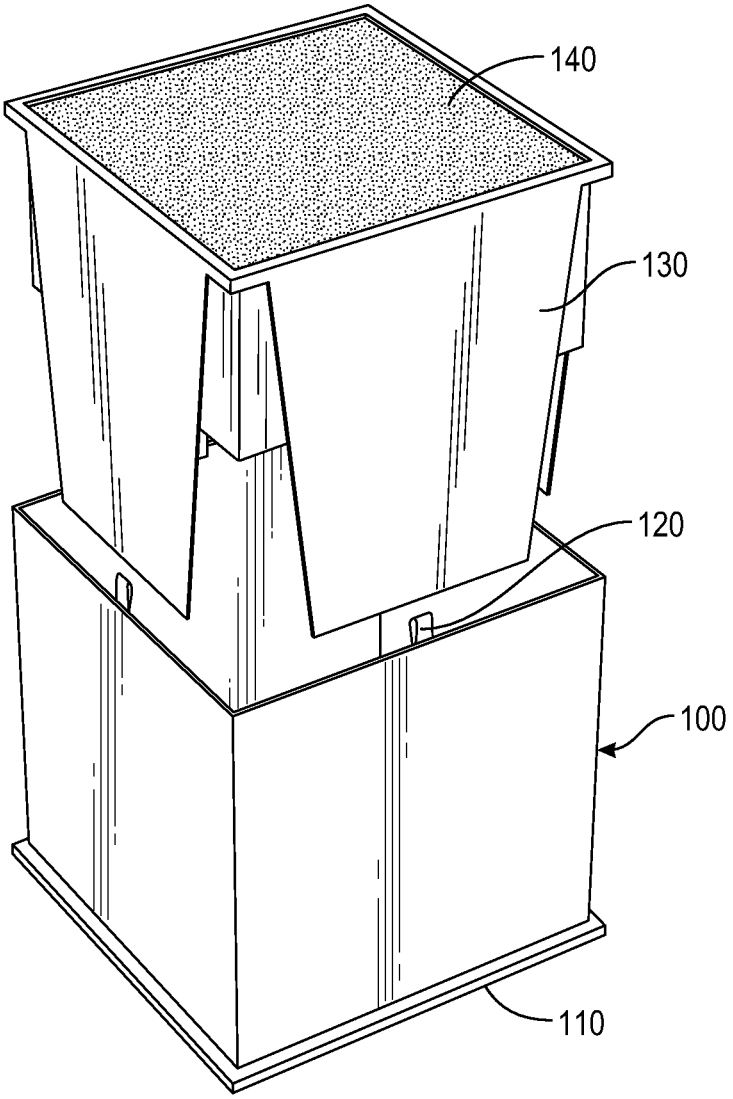
FIG. 8 is a perspective view of FIG. 7, wherein the foam is disposed in the liner.

FIG. 8 is a perspective view of FIG. 7, wherein the foam is disposed in the liner. Referring to FIG. 8, although the foam 140 is shown as being disposed in the liner 130 before the liner 130 is disposed in the inner container 100, it should be understood that the assembly may occur in a different order. For instance, the liner 130 may be disposed in the inner container 100 before the foam 140 is disposed in the liner 130.

Figure 9:
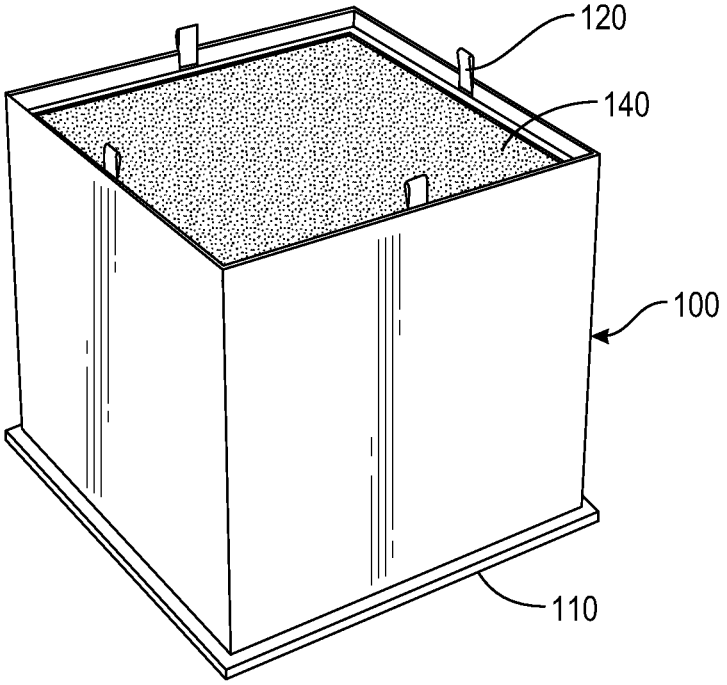
FIG. 9 is a perspective view of FIG. 8, wherein the liner with the foam is disposed in the inner container.

FIG. 9 is a perspective view of FIG. 8, wherein the liner with the foam is disposed in the inner container. Referring to FIG. 9, the foam 140 may be secured within the inner container 100 using the fasteners 120, and the creation of the floral arrangement and the seating of the inner container 100 within the outer container 200 may be as discussed supra.

As disclosed herein, a method of packaging a botanical arrangement may include sliding an inner container 100 holding the botanical arrangement into a front opening of an outer container 200. The inner container 100 has a flanged portion 110, and the outer container 200 has a track system 210 configured such that the flanged portion 110 of the inner container 100 engages with the track system 210 of the outer container 200 during the sliding. In addition, the method includes closing the front opening of the outer container 200 by lifting the hinged front panel 230 of the outer container 200.

A method of making a packaging system for a botanical arrangement may include fabricating a first blank for an inner container 100 configured to hold the botanical arrangement. In addition, the method may include assembling the first blank to form the inner container 100 such that the inner container 100 has a flanged portion 110. The method may also include fabricating a second blank for an outer container 200 configured to receive the inner container 100. Furthermore, the method may include assembling the second blank to form the outer container 200 such that the outer container 200 has a bottom panel 270, a track system 210 on the bottom panel 270, and a front panel 230 hinged to the bottom panel 270, the inner container 100 configured to slide into the outer container 200 via the track system 210 such that the flanged portion 110 of the inner container 100 is between the track system 210 and the bottom panel 270 of the outer container 200 when the inner container 100 is seated within the outer container 200.

A packaging system for a botanical arrangement includes an inner container 100 configured to hold the botanical arrangement. The inner container 100 has a flanged portion 110. In addition, the packaging system includes an outer container 200 having a bottom panel 270, a track system 210 on the bottom panel 270, and a front panel 230 hinged to the bottom panel 270. The inner container 100 is configured to slide into the outer container 200 via the track system 210 such that the flanged portion 110 of the inner container 100 is between the track system 210 and the bottom panel 270 of the outer container 200 when the inner container 100 is seated within the outer container 200.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. A system for packaging a botanical arrangement, the system comprising:

an outer container in the form of a box, the outer container comprising:

a front panel hingedly connected to a bottom panel;

a lid hingedly connected to a rear panel; and a track system;

an inner container configured to hold the botanical arrangement; and a glide structure, wherein a first end of the glide structure includes a raised flange and a second end of the glide structure includes a stopper having side flanges, wherein a base of the inner container seats into the glide structure with a rearward-facing edge of the inner container abutting the raised flange and a forward-facing edge of the inner container abutting the stopper, wherein the track system is configured to receive the glide structure, with the inner container seated therein, through a front opening of the outer container, wherein the raised flange, a flanged portion of the inner container, and the side flanges engage the track system as the glide structure is received into the track system, wherein, once the glide structure is fully received into the track system, the stopper is positioned and fills a space between the inner container and the front opening and the track system abuts a rear surface of the raised flange to limit a distance of travel of the glide structure into the outer container, such that the distance of travel is less than a distance from the front opening to the rear panel, wherein the front panel is configured to close the front opening of the outer container, wherein the front panel abuts the stopper to immobilize the inner container within the outer container, and wherein the lid is configured to close a top opening of the outer container and overlaps an upper portion of the front panel when both the lid and front panel of the outer container are in a closed position.

2. The system of claim 1, wherein the flanged portion extends beyond at least three sides of the inner container.

3. The system of claim 1, wherein the track system is generally u-shaped.

4. The system of claim 1, wherein a height of the outer container is greater than a height of the inner container, wherein, when the lid of the outer container is in a closed position, an uppermost edge of the inner container is below an interior surface of the lid.

5. The system of claim 1, wherein the flanged portion extends beyond all sides of the inner container.

6. The system of claim 1, wherein the track system is configured to restrict a vertical displacement of the inner container once the inner container is seated within the outer container.

7. The system of claim 1, wherein the track system is disposed on a bottom panel of the outer container.

8. The system of claim 1, wherein a first portion of the track system is disposed along a first side panel of the outer container, and wherein a second portion of the track system is disposed along an opposing second side panel of the outer container.

9. The system of claim 1, wherein the track system has an overhang portion configured to engage with the flanged portion during the sliding of the inner container into the outer container.

10. The system of claim 1, wherein the flanged portion of the inner container is disposed at a bottom of the inner container.

11. The system of claim 1, wherein, in an open position, the front panel is configured to be coplanar with the bottom panel.

12. The system of claim 1, wherein the inner container includes a liner within the inner container, the liner being impermeable to liquids.

13. The system of claim 12, wherein the liner is a film that conformally coats internal surfaces of the inner container.

14. The system of claim 12, wherein the liner is an insert configured to be seated within the inner container.

15. A method of packaging a botanical arrangement, the method comprising:

seating an inner container holding the botanical arrangement into a glide structure, wherein a first end of the glide structure includes a raised flange and a second end of the glide structure includes a stopper having side flanges, wherein a rearward-facing edge of the inner container abuts the raised flange and a forward-facing edge of the inner container abuts the stopper;

then sliding the glide structure, with the inner container seated therein, into a front opening of an outer container, wherein the raised flange, a flanged portion of the inner container, and the stopper side flanges engage a track system of the outer container during the sliding, wherein the track system limits a distance of travel of the glide structure into the outer container, such that the distance of travel is less than a distance from the front opening to a rear panel of the outer container, wherein, once the glide structure is fully inserted into the track system, the stopper is positioned and fills a space between the inner container and the front opening;

then closing the front opening with a front panel of the outer container, wherein in a closed position, the front panel abuts the stopper and the inner container is immobilized; and finally closing a top opening of the outer container with a lid, wherein the top opening is closed after the front opening is closed, wherein, in a closed position, the lid is configured to engage an upper portion of the front panel to secure the front panel in the closed position.

16. The method of claim 15, wherein, prior to sliding the inner container into the front opening, the method further comprises:

wetting an open-celled phenolic foam;

setting the open-celled phenolic foam within the inner container; and inserting botanic articles into the open-celled phenolic foam to create the botanical arrangement.

17. The method of claim 16, further comprising:

securing the open-celled phenolic foam to the inner container with at least one strip of material prior to the inserting of the botanic articles into the open-celled phenolic foam, the at least one strip of material being attached to the inner container.

* * * * *